US010770781B1

(12) United States Patent
Harper

(10) Patent No.: US 10,770,781 B1
(45) Date of Patent: Sep. 8, 2020

(54) RESONANT CAVITY AND PLATE HYBRID ANTENNA

(71) Applicant: Microsoft Technology Licensing, LLC, Redmond, WA (US)

(72) Inventor: Marc Harper, Snohomish, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 9 days.

(21) Appl. No.: 16/285,644

(22) Filed: Feb. 26, 2019

(51) Int. Cl.

| | |
|---|---|
| ***H01Q 1/12*** | (2006.01) |
| ***H01Q 1/22*** | (2006.01) |
| ***H01Q 5/10*** | (2015.01) |
| ***H01Q 9/04*** | (2006.01) |
| ***H01Q 5/30*** | (2015.01) |
| *H01Q 13/24* | (2006.01) |

(52) U.S. Cl.
CPC ..... *H01Q 1/2266* (2013.01); *H01Q 5/10* (2015.01); *H01Q 5/30* (2015.01); *H01Q 9/0485* (2013.01); *H01Q 1/12* (2013.01); *H01Q 1/2258* (2013.01); *H01Q 13/24* (2013.01)

(58) Field of Classification Search
CPC ..... H01Q 1/12; H01Q 1/2258; H01Q 13/24
USPC ..... 343/878; 455/347, 349
See application file for complete search history.

(56) References Cited

U.S. PATENT DOCUMENTS

| | | | | |
|---|---|---|---|---|
| 6,091,373 | A | 7/2000 | Raguenet | |
| 6,680,712 | B2 * | 1/2004 | Yamamoto | H01Q 1/007 343/700 MS |
| 8,125,394 | B2 * | 2/2012 | Chiang | H01Q 9/30 343/702 |
| 8,410,986 | B2 | 4/2013 | Hill et al. | |
| 8,489,162 | B1 | 7/2013 | Dou et al. | |
| 9,577,331 | B2 * | 2/2017 | Tseng | H01Q 1/243 |
| 9,698,466 | B2 * | 7/2017 | Harper | H01Q 5/328 |
| 9,705,571 | B2 | 7/2017 | Gerszberg et al. | |
| 9,837,697 | B2 * | 12/2017 | Strong | H05K 1/025 |
| 10,211,504 | B2 * | 2/2019 | Strong | H01P 5/028 |
| 10,615,480 | B2 * | 4/2020 | Strong | H05K 1/025 |

(Continued)

FOREIGN PATENT DOCUMENTS

| | | |
|---|---|---|
| CN | 102842757 A | 12/2012 |
| CN | 103151618 A | 6/2013 |

(Continued)

OTHER PUBLICATIONS

Costa, et al., "Dual-Band Slotted Waveguide Antenna Array for Adaptive Mm-wave 5G Networks", In Proceedings of 11th European Conference on Antennas and Propagation, Mar. 19, 2017, pp. 1322-1325.

(Continued)

*Primary Examiner* — Thuy Vinh Tran
(74) *Attorney, Agent, or Firm* — Holzer Patel Drennan

(57) ABSTRACT

A computing device includes a metal frame forming an exterior surface of the computing device and including an array of resonant cavities. Each resonant cavity has a center axis and defining a volume within the metal frame. Each volume contains a corresponding metal plate positioned within the volume on the center axis of the resonant cavity and a corresponding metal feed line positioned to capacitively drive the corresponding metal plate and the resonant cavity. A least a portion of the corresponding metal feed line is positioned within the volume on the center axis of the resonant cavity.

20 Claims, 6 Drawing Sheets

(56) References Cited

U.S. PATENT DOCUMENTS

| | | | | |
|---|---|---|---|---|
| 2008/0001837 | A1* | 1/2008 | Liu | H01Q 1/243 343/767 |
| 2011/0279339 | A1 | 11/2011 | Johnston | |
| 2014/0347227 | A1* | 11/2014 | Iellici | H01Q 9/42 343/702 |
| 2017/0309993 | A1 | 10/2017 | Tu et al. | |
| 2019/0190110 | A1* | 6/2019 | Clark | H05K 1/0237 |

FOREIGN PATENT DOCUMENTS

| | | | |
|---|---|---|---|
| CN | 105990645 | A | 10/2016 |
| EP | 1796213 | A1 | 6/2007 |
| WO | 0141256 | A1 | 6/2001 |

OTHER PUBLICATIONS

"International Search Report and Written Opinion Issued in PCT Application No. PCT/US2020/017404", dated May 13, 2020, 15 Pages.

* cited by examiner

RESONANT CAVITY AND PLATE HYBRID ANTENNA

BACKGROUND

The "5$^{th}$ Generation" (5G) standard for cellular mobile communications succeeds earlier standards, such as the 4G (LTE/WiMax), 3G (UMTS) and 2G (GSM) standards. 5G is intended to provide higher data rates, reduced latency, energy savings, cost reductions, higher system capacities, and broader device connectivity than the previous standards. 5G offers two frequency bands, the higher of which is referred to as FR2 or millimeter wave (mmWave) operation and ranges from 24 GHz to 86 GHz. At least two major carriers are expected to launch mmWave deployments between 24 GHz and 38 GHz. However, designing a 5G antenna that operates acceptably across such a wide bandwidth is problematic using existing antenna implementations, such as typical patch antennas, because they provide operational bandwidths that are too narrow to support such a wide range of frequencies.

SUMMARY

The described technology addresses such limitations by providing a computing device including a metal frame forming an exterior surface of the computing device and including an array of resonant cavities. Each resonant cavity has a center axis and defining a volume within the metal frame. Each volume contains a corresponding metal plate positioned within the volume on the center axis of the resonant cavity and a corresponding metal feed line positioned to capacitively drive the corresponding metal plate and the resonant cavity. At least a portion of the corresponding metal feed line is positioned within the volume on the center axis of the resonant cavity.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

Other implementations are also described and recited herein.

BRIEF DESCRIPTIONS OF THE DRAWINGS

DETAILED DESCRIPTIONS

The described technology provides a hybrid antenna assembly that is capable of providing acceptable antenna performance over a wide frequency bandwidth, such as between 24 GHz and 38 GHz for 5G mmWave deployments. In one implementation, the described hybrid antenna assembly provides a return loss no more than −5 dB from 24 GHz to over 40 GHz and a return loss of equal to or less than −10 dB in frequencies bands centered near 28 GHz and 38 GHz, although other performance objectives may be achieved. The center frequencies can be adjusted to higher or lower frequencies by adjusting component dimensions and geometries and/or the matching characteristics of a metal feed line. Accordingly, the low return loss of the hybrid antenna assembly across the wide range of 24 GHz to 40 GHz allows a computing device to be selectively configured via software (or a hardware switch) to operate at multiple frequency bands having center frequencies across this wide frequency range without requiring a modification to the physical structure of the hybrid antenna assembly. However, designing a 5G antenna that operates acceptably across such a wide bandwidth is problematic using existing antenna implementations, such as typical patch antennas, because they provide operational bandwidths that are too narrow to support such a wide range of frequencies.

Figure 1:
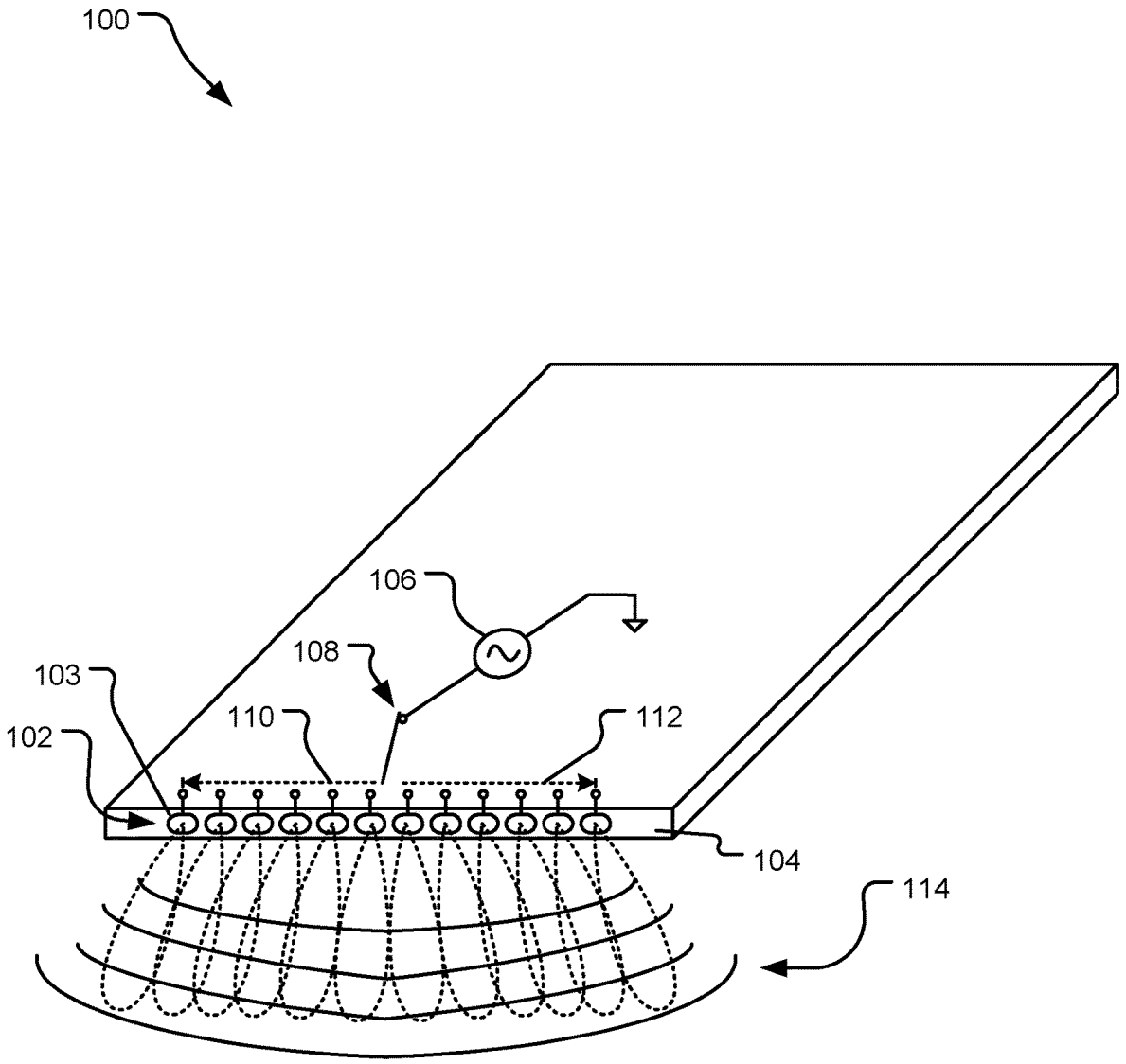
FIG. 1 illustrates an example computing device with an array of antenna assemblies positioned on an edge of a metal computing device case.

FIG. 1 illustrates an example computing device 100 with an array 102 of antenna assemblies (such as antenna assembly 103) positioned on a metal frame 104 of a metal computing device case. In the illustrated implementation, the resonant cavity of each antenna assembly forms an oblong aperture in a surface of the metal frame as an opening to the resonant cavity. The aperture can be substantially square or circular in its basic shape, and the term "oblong" means deviating from a square or circular form by elongation in one dimension. In other variations, the aperture may be in the form of other shapes, including without limitation circles and other curved shapes, squares, hexagons, octagons and other multi-sided polygons, and combinations of curved and straight sided shapes. The resonant cavity of each antenna assembly also defines a volume within the metal frame 104. In one implementation, the volume of the resonant cavity contains a metal plate and at least a portion of a metal feed line (e.g., a metal trace or other conductor). The volume of the resonant cavity may also contain a non-gaseous dielectric material "filler," which maintains separation among the metal feed line, the metal plate, and the interior surface of the resonant cavity.

Each antenna assembly is electrically connectable to a radio frequency signal source 106 by a radio frequency switch 108. The radio frequency signal source 106 can be set to source a radio frequency signal through the radio frequency switch 108 to one or more of the metal feed lines of the antenna assemblies. The radio frequency signal is an electrical signal that can be centered about one of multiple center frequencies within the wide frequency bandwidth supported by the antenna assemblies. For example, one mobile communications carrier may be licensed to use a frequency band centered at about 28 GHz, and another may be licensed to use a frequency band center at about 38 GHz. The radio frequency signal source can be set (e.g., by a software setting) to supply a signal centered at either frequency, and the antenna assemblies can provide excellent return loss performance at either center frequency.

In one implementation, the different center frequencies available for the radio frequency signal can resonate different sets of antenna components, thereby selecting the frequency band of radio frequency waves generated by each antenna assembly. For example, based on the antenna component dimensions and geometries and/or the matching characteristics of a metal feed line, if the radio frequency signal is set near a first center frequency, the metal feed line can capacitively drive the resonant cavity to resonate predominately within a first frequency band. Alternatively, if the radio frequency signal is set near a second center frequency, the metal feed line can capacitively drive the metal plate to resonate so that the metal plate capacitively drives the resonant cavity to resonate predominately within a second frequency band.

An antenna assembly capable of such performance across a wide range of frequencies can support multiple carriers in multiple jurisdictions without physically modifying the antenna assembly design. Example 5G frequency bands used in various jurisdictions are listed in the table below:

TABLE 1

Example 5G Frequency Bands

| Jurisdictions | 5G Frequency Bands |
|---|---|
| USA | 27.5-28.35 GHz, 37-40 GHz |
| South Korea | 26.5-29.5 GHz |
| Japan | 27.5-28.28 GHz |
| China | 24.25-27.5 GHz, 37-43.5 GHz |
| Sweden | 26.5-27.5 GHz |
| EU | 24.25-27.5 GHz |

The radio frequency switch 108 can also selectively supply the radio frequency signal to any of the antenna assemblies and can scan from one antenna assembly to another, as illustrated by the dashed arrows 110 and 112 and the scanned radio frequency waves 114, to provide multi-beam active antenna operation. Such beam scanning and steering techniques can provide acceptable gain for millimeter wave frequencies while allowing smaller antennas.

Each antenna assembly includes a resonant cavity cut or otherwise formed in the metal frame 104 of the computing device case. In the illustrated implementation, the metal frame 104 is positioned as an exterior surface at an edge of the computing device 100, although other implementations may position the metal frame 104 at other surfaces of the computing device 100.

Figure 2:
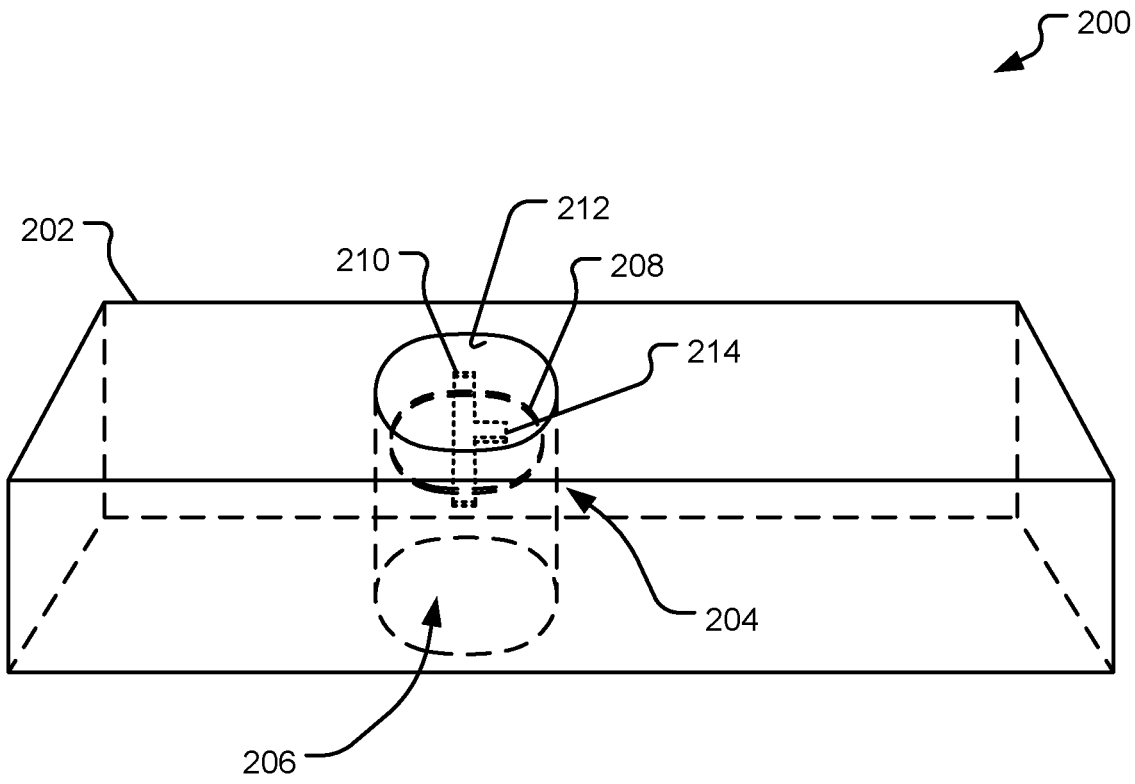
FIG. 2 illustrates a perspective view of an example antenna assembly.

FIG. 2 illustrates a perspective view of an example antenna assembly 200. A portion of a metal frame 202 is shown with single antenna assembly 204. The antenna assembly 204 includes a resonant cavity 206 formed between two exterior surfaces of the metal frame 202. The resonant cavity 206 defines a substantially cylindrical volume having an oblong cross-section (e.g., 3 mm×3.5 mm, 4 mm×4.5 mm) and having a center axis extended substantially orthogonally between the two surfaces. It should be understood that other three-dimensional shapes of resonant cavities may be employed, including substantially box-like cavities with square apertures. "Orthogonal" is defined to mean 90°, give or take reasonable manufacturing tolerances. "Substantially orthogonally" is defined to mean less than 3° from orthogonal. Likewise, implementations may include sloped cavities in which the center axis is at an angle other than 90° with reference to one or more surfaces of the metal frame 202. For example, in some implementations, the center axis may be off-orthogonal by less than 5°, less than 10°, less than 20°, and by more than 20° at one or more of the surfaces of the metal frame 202.

The volume of the resonant cavity 206 contains a metal plate 208 that is separated from the metal frame 202 and the interior surface of the resonant cavity 206 by a non-gaseous dielectric material. In one implementation, the metal plate 208 is substantially circular or oblong and is centered at and oriented orthogonal to a center axis of the resonant cavity 206 extending between opposing surfaces of the metal frame 202. In other implementations, the metal plate 208 may be positioned off-center with respect to the center axis of the resonant cavity 206 (in one or more dimensions) and may be off-orthogonal by less than 5°, less than 10°, less than 20°, and by more than 20° with respect to the center axis of the resonant cavity 206.

The volume of the resonant cavity 206 also contains at least a portion of a metal feed line 210 that can be electrically connected to a radio frequency signal source (not shown in FIG. 2), which provides a radio frequency signal to the metal feed line 210. In various implementations, the resonant cavity 206 is at least partially filled with the non-gaseous dielectric material that supports the metal plate and metal feed line 210 within the resonant cavity 206 and maintains separation among the metal feed line 210, the metal plate 208, and the interior surface 212 of the resonant cavity 206. In one implementation, the metal plate 208 is positioned within the resonant cavity 206 between an exterior surface of the metal frame 202 and the metal feed line 210, although in alternative implementations, the relative positioning of the metal plate 208 and the metal feed line 210 within the resonant cavity 206 can vary.

The center frequency and bandwidth of a first frequency band supported by the antenna assembly 200 are functions of at least the dielectric constant of the dielectric material and the depth and cross-sectional size of the resonant cavity 206 (e.g., as cut across the center axis). The center frequency and bandwidth of a second frequency band supported by the antenna assembly 200 are functions of at least the dielectric constant of the dielectric material, the size of the metal plate 208 (e.g., as measured across the center axis) and the depth of the metal plate 208 within the resonant cavity 206. In one implementation, the metal plate 208 is approximately 2 mm thick, subject to manufacturing tolerances, although other thicknesses may be employed.

The impedance matching of the antenna assembly 200 is a function of at least the dielectric constant of the dielectric material, the depth of the metal feed line 210 in the resonant cavity 206 and the geometry of the metal feed line 210. In the illustrated implementation, the geometry of the metal feed line 210 includes a coupling stub 214, which operates as an inductor to set the impedance matching in the antenna assembly 200.

In one implementation, in which a radius at the major axis of the aperture is 2.2 mm and the radius at the minor axis of the aperture is 1.804 mm, an example metal plate has a radius at the major axis of 1 mm and a radius at a minor radius of 1.4 mm. In some example implementations, the resonant cavity 206 is 1.0-2.0 mm deep, the metal plate 208 is 0.8 mm-1.50. mm thick and positioned at a 0.1 mm-1.0 mm depth within the resonant cavity 206, and the metal feed line 210 is positioned at a 0.1 mm-1.0 mm distance from the metal plate 208 within the resonant cavity 206. In one implementation, the metal feed line 210 is 2.8 mm long, with a coupling stub 1.5 mm long. Other configurations and dimensions may be employed to result in the same or different center frequencies and different bandwidths.

Figure 3:
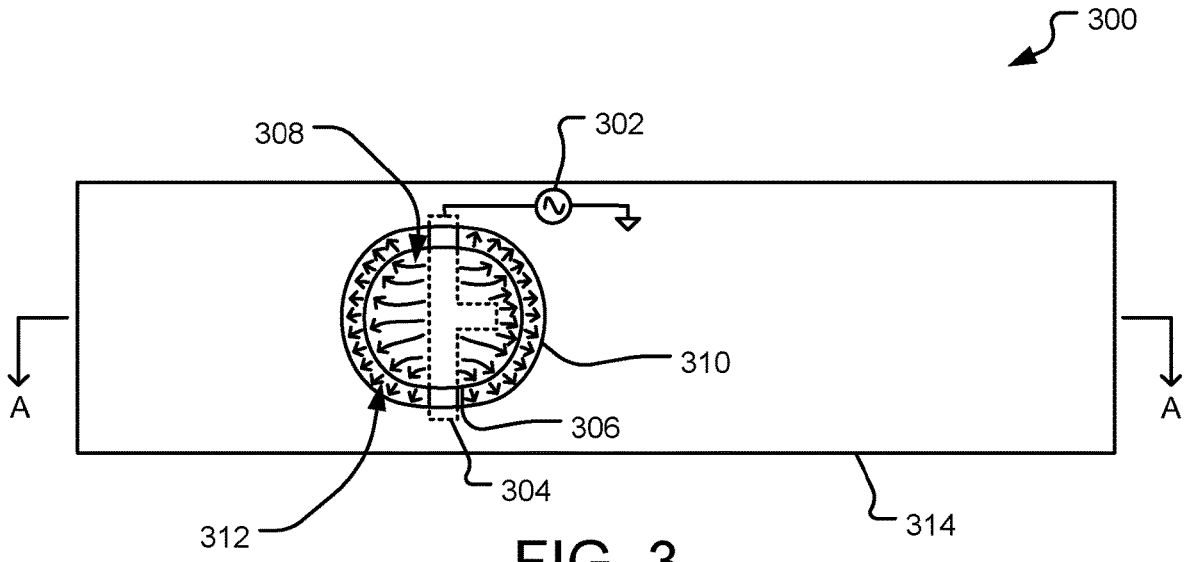
FIG. 3 illustrates a plan view of an example antenna assembly 300 operating predominantly within a first frequency band.
Figure 3A:
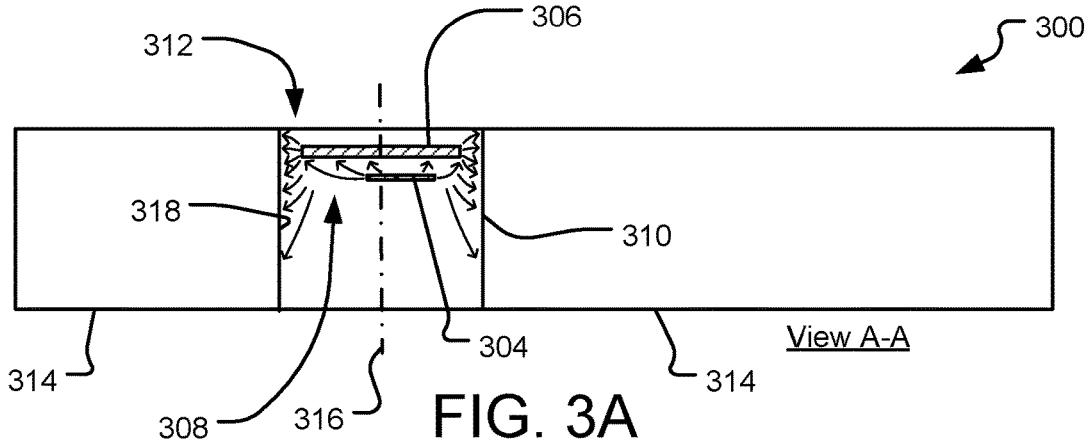
FIG. 3A illustrates a corresponding cross-sectional view A-A of the example antenna assembly of FIG. 3.

FIG. 3 illustrates a plan view of an example antenna assembly 300 operating predominantly within a first frequency band, and FIG. 3A illustrates a corresponding cross-sectional view A-A of the example antenna assembly 300 of FIG. 3. FIG. 3 also includes a schematic representation of a radio frequency signal source 302, and FIGS. 3 and 3A also include arrows depicting capacitive coupling between a metal feed line 304 and a metal plate 306 (as shown by arrows 308) and between the metal plate 306 and a resonant cavity 310 (as shown by arrows 312).

As illustrated, the resonant cavity 310 presents an oblong aperture in the surface of a metal frame 314 and extends through the thickness of the metal frame 314. In the illustrated implementations, the resonant cavity 310 of each antenna assembly extends completely through the metal frame 314 (e.g., presenting opposing apertures on opposing surfaces of the metal frame 314, although in some implementations, one or more of the resonant cavities in an array may not extend completely through the metal frame 314 (e.g., the resonant cavity 310 may be open on one surface of the metal frame 314 and closed on the opposing surface of the metal frame 314). The metal feed line 304 is positioned within the resonant cavity 310, and the metal plate 306 is positioned between the metal feed line 304 and a surface of the metal frame 314. The metal plate 306 is also centered at a center axis 316 of the resonant cavity 310. Both the metal plate 306 and the metal feed line 304 are positioned orthogonal to the center axis 316. In some implementations, one or more of the metal plate 306 and the metal feed line 304 may be positioned off-center with respect to the center axis of the resonant cavity 310 (in one or more dimensions) and may be off-orthogonal by less than 5°, less than 10°, less than 20°, and by more than 20° with respect to the center axis of the resonant cavity 310.

A non-gaseous dielectric material substantially fills the resonant cavity 310, suspending the metal plate 306 and the metal feed line 304 and maintaining electrical separate among the metal plate 306, the metal feed line 304, and the interior surface 318 of the resonant cavity 310. It should be understood that alternative configurations may be employed, including without limitation configurations with off-center positioning, different relative positions, and substantially square apertures.

In the capacitive coupling illustrated in FIG. 3, the radio frequency signal source 302 galvanically drives the metal feed line 304 to resonate and capacitively drive the metal plate 306, which in turn resonates and capacitively drives the resonant cavity 310 at a center frequency within a first frequency band.

Figure 4:
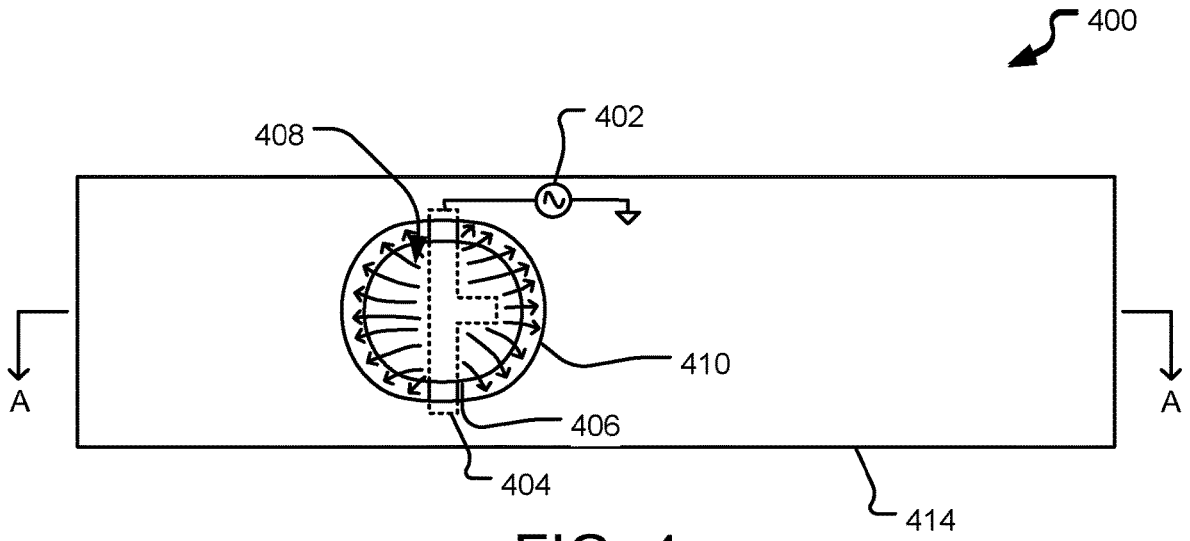
FIG. 4 illustrates a plan view of an example antenna assembly operating predominantly within a second frequency band.
Figure 4A:
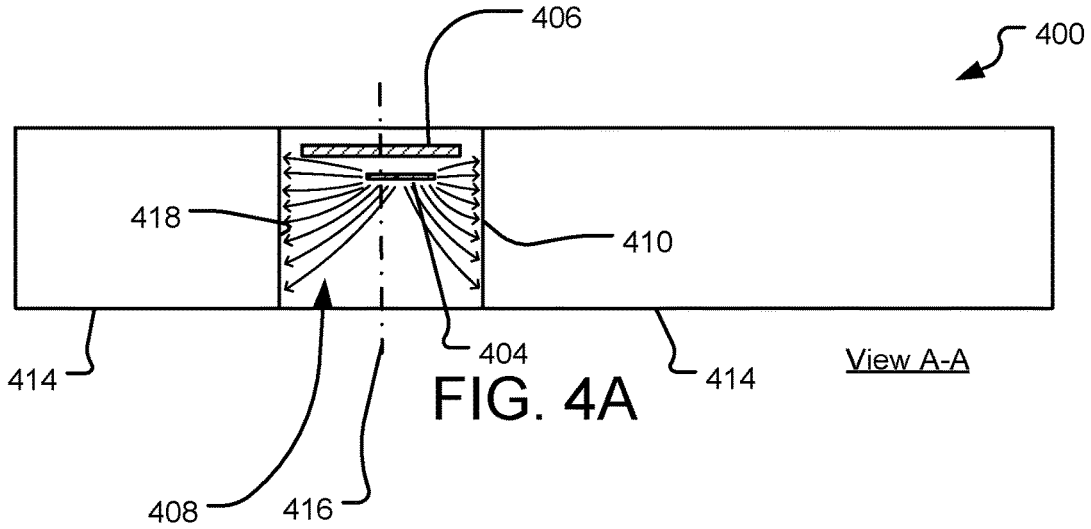
FIG. 4A illustrates a corresponding cross-sectional view A-A of the example antenna assembly of FIG. 4.

FIG. 4 illustrates a plan view of an example antenna assembly 400 operating predominantly within a second frequency band, and FIG. 4A illustrates a corresponding cross-sectional view A-A of the example antenna assembly 400 of FIG. 4. FIG. 4 also includes a schematic of a representation of a radio frequency signal source 402, and FIG. 4A also includes arrows 408 depicting capacitive coupling between a metal feed line 404 and a resonant cavity 410.

As illustrated, the resonant cavity 410 presents an oblong aperture in the surface of a metal frame 414 and extends through the thickness of the metal frame 414. The metal feed line 404 is positioned within the resonant cavity 410, and the metal plate 406 is positioned between the metal feed line 404 and a surface of the metal frame 414. The metal plate 406 is also centered at a center axis 416 of the resonant cavity 410. Both the metal plate 406 and the metal feed line 404 are positioned orthogonal to the center axis 416. A non-gaseous dielectric material substantially fills the resonant cavity 410, suspending the metal plate 406 and the metal feed line 404 and maintaining electrical separate among the metal plate 406, the metal feed line 404, and the interior surface 418 of the resonant cavity 410. It should be understood that alternative configurations may be employed, including without limitation configurations with off-center positioning, different relative positions, and substantially square apertures.

In the capacitive coupling illustrated in FIG. 4, the radio frequency signal source 402 galvanically drives the metal feed line 404 to resonate and capacitively drive the resonant cavity 410 at a center frequency within a second frequency band, which is different than the first frequency band of the configuration shown in FIG. 3.

Figure 5:
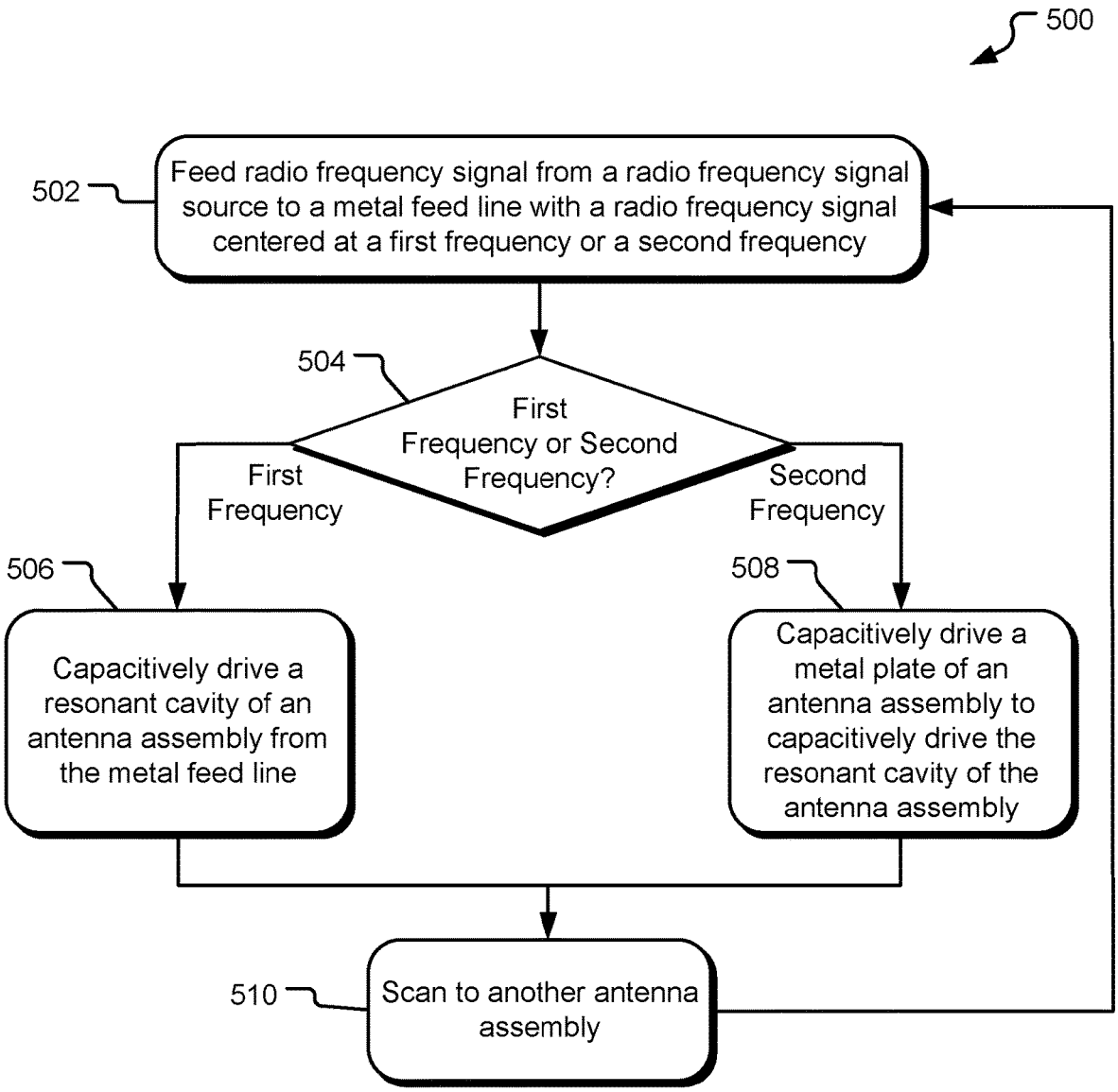
FIG. 5 illustrates example operations for selectively driving hybrid antenna assemblies of a computing device.

FIG. 5 illustrates example operations 500 for selectively driving hybrid antenna assemblies of a computing device. Each antenna assembly includes a metal frame including a resonant cavity having a center axis and defining a volume within the metal frame, a metal plate positioned within the volume orthogonal to the center axis of the resonant cavity, and a metal feed line. In one implementation, the antenna assemblies are configured in an array along an exterior surface of the computing device, such as at an edge of the computing device.

A signaling operation 502 selective feeds a radio frequency signal from a radio frequency signal source to a metal feed line of one of the antenna assemblies. The radio frequency signal is centered at a first frequency or a second frequency. Depending on the frequency at which the radio frequency signal is centered (as illustrated by block 504), a driving operation 506 or a driving operation 508 is performed. The driving operation 506 capacitively drives the resonant cavity of the antenna assembly from the metal feed line predominantly in a first frequency band. The driving operation 508 capacitively drives the metal plate of the antenna assembly by the metal feed line, and the metal plate resonates to capacitively drive the resonant cavities to resonate predominantly in a second frequency band. A scanning operation 510 scans the radio frequency signal to another antenna assembly.

Figure 6:
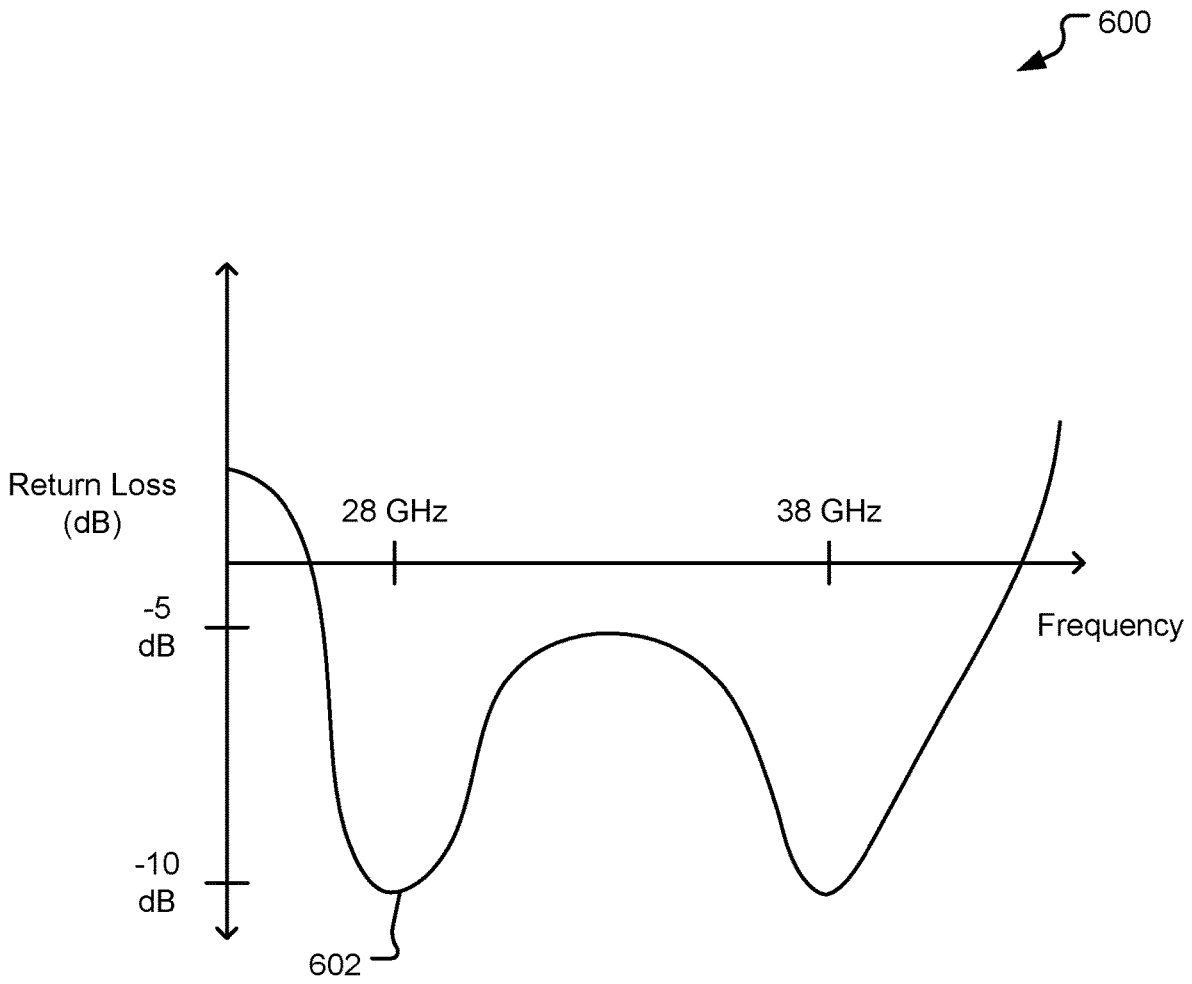
FIG. 6 illustrates return loss across a range of frequencies of an example antenna assembly of the described technology.

FIG. 6 illustrates a graph 600 of return loss 602 across a range of frequencies of an example antenna assembly of the described technology. As shown in the graph 600, the return loss 602 centered at 28 GHz and 38 GHz is about −10 dB, and between those two center frequencies, the return loss 602 does not rise above −5 dB. Accordingly, the performance of the example antenna assembly provides good performance across a wide range of frequencies, thereby supporting antenna operation at both center frequencies without modification of the physical structure of the example antenna assembly.

An example antenna assembly includes a metal frame including a resonant cavity, wherein the resonant cavity has a center axis and defines a volume within the metal frame, a metal plate positioned within the volume on the center axis of the resonant cavity, and a metal feed line positioned to capacitively drive the metal plate and the resonant cavity, wherein at least a portion of the metal feed line is positioned within the volume on the center axis of the resonant cavity.

Another example antenna assembly of any preceding antenna assembly is provided wherein the metal frame forms an exterior surface of a computing device.

Another example antenna assembly of any preceding antenna assembly is provided wherein the center axis of the resonant cavity extends orthogonally between a first surface of the metal frame and an opposite second surface of the metal frame.

Another example antenna assembly of any preceding antenna assembly is provided wherein the resonant cavity forms an oblong aperture in a surface of the metal frame.

Another example antenna assembly of any preceding antenna assembly is provided wherein the resonant cavity has an interior surface, and the antenna assembly further includes a non-gaseous dielectric material within the resonant cavity, the non-gaseous dielectric material maintaining separation among the metal plate, the metal feed line, and the interior surface of the resonant cavity.

Another example antenna assembly of any preceding antenna assembly further includes a radio frequency signal source electrically connected to the metal feed line, the metal feed line being positioned to capacitively drive the resonant cavity.

Another example antenna assembly of any preceding antenna assembly further includes a radio frequency signal source electrically connected to the metal feed line, the metal feed line being positioned to capacitively drive the metal plate to capacitively drive the resonant cavity.

Another example antenna assembly of any preceding antenna assembly further include a radio frequency signal source electrically connected to the metal feed line, the metal feed line being positioned to capacitively drive the resonant cavity predominantly in a first frequency band and to capacitively drive the metal plate to capacitively drive the resonant cavity predominantly in a second frequency band.

The antenna assembly of claim 8 wherein the width and a center frequency of the first frequency band are dependent upon the size of the resonant cavity.

The antenna assembly of claim 8 wherein the width and a center frequency of the second frequency band are dependent upon the size of the metal plate and the depth the metal plate is positioned within the resonant cavity from an exterior surface of the metal frame.

The antenna assembly of claim 8 wherein the ranges of the first frequency band and the second frequency band are dependent upon impedance matching contributions of a geometry of the at least a portion of the metal feed line within the resonant cavity and the position of the metal feed line along the center axis.

An example computing device includes a metal frame forming an exterior surface of the computing device and including an array of resonant cavities, wherein each resonant cavity has a center axis and defines a volume within the metal frame. Each volume contains a corresponding metal plate positioned within the volume on the center axis of the resonant cavity, and a corresponding metal feed line positioned to capacitively drive the corresponding metal plate and the resonant cavity, wherein at least a portion of the corresponding metal feed line is positioned within the volume on the center axis of the resonant cavity.

Another example computing device of any preceding computing system is provided wherein each resonant cavity forms an oblong aperture in a surface of the metal frame.

Another example computing device of any preceding computing system is provided wherein each resonant cavity has an interior surface, and the computing device further includes a non-gaseous dielectric material within each resonant cavity, the non-gaseous dielectric material maintaining separation among the corresponding metal plate, the corresponding metal feed line, and the interior surface of the resonant cavity.

Another example computing device of any preceding computing system further includes a radio frequency signal source electrically connectable to the corresponding metal feed line of each resonant cavity, the corresponding metal feed line being positioned to capacitively drive the resonant cavity predominantly in a first frequency band and to capacitively drive the corresponding metal plate to capacitively drive the resonant cavity predominantly in a second frequency band.

Another example computing device of any preceding computing system is provided wherein the width and a center frequency of the first frequency band are dependent upon the size of the resonant cavity.

Another example computing device of any preceding computing system is provided wherein the width and a center frequency of the second frequency band are dependent upon the size of the metal plate and the depth the metal plate is positioned within the resonant cavity from an exterior surface of the metal frame.

Another example computing device of any preceding computing system is provided wherein the ranges of the first frequency band and the second frequency band are dependent upon impedance matching contributions of a geometry of the at least a portion of the metal feed line within the resonant cavity and the position of the metal feed line along the center axis.

An example method of selectively driving antenna assemblies of a computing device is provided. Each antenna assembly includes a metal frame including a resonant cavity having a center axis and defining a volume within the metal frame, a metal plate positioned within the volume on the center axis of the resonant cavity, and a metal feed line. The example method includes selectively setting a radio frequency signal source electrically connected to at least one of the metal feed lines to provide a radio frequency signal having one of a first frequency and a second frequency. The example method also includes capacitively driving at least one of the metal plates by the at least one of the metal feed lines at the first frequency, the at least one of the metal plates resonating to capacitively drive at least one of the resonant cavities to resonate predominantly in a first frequency band, and capacitively driving the at least one of the resonant cavities by the at least one of the metal feed lines at the second frequency to resonate predominantly in a second frequency band.

Another example method of any preceding method is provided wherein the capacitively driving operations includes scanning the radio frequency signal across the metal feed lines of the antenna assemblies.

An example system for selectively driving antenna assemblies of a computing device is provided. Each antenna assembly includes a metal frame including a resonant cavity having a center axis and defining a volume within the metal frame, a metal plate positioned within the volume on the center axis of the resonant cavity, and a metal feed line. The example system includes means for selectively setting a radio frequency signal source electrically connected to at least one of the metal feed lines to provide a radio frequency signal having one of a first frequency and a second frequency. The example system also includes means for capacitively driving at least one of the metal plates by the at least one of the metal feed lines at the first frequency, the at least one of the metal plates resonating to capacitively drive at least one of the resonant cavities to resonate predominantly in a first frequency band, and means for capacitively driving the at least one of the resonant cavities by the at least one of the metal feed lines at the second frequency to resonate predominantly in a second frequency band.

Another example system of any preceding system is provided wherein the means for capacitively driving operations includes means for scanning the radio frequency signal across the metal feed lines of the antenna assemblies.

Other implementations are also described and recited herein. This Summary is provided to introduce a selection of concepts in a simplified form that are further described below in the Detailed Descriptions. This Summary is not intended to identify key features or essential features of the claimed subject matter, nor is it intended to be used to limit the scope of the claimed subject matter.

What is claimed is:

1. An antenna assembly comprising:

a metal frame including a resonant cavity, the resonant cavity having a center axis and defining a volume within the metal frame;

a metal plate positioned within the volume on the center axis of the resonant cavity; and a metal feed line positioned to capacitively drive the metal plate and the resonant cavity, at least a portion of the metal feed line being positioned within the volume on the center axis of the resonant cavity.

2. The antenna assembly of claim 1 wherein the metal frame forms an exterior surface of a computing device.

3. The antenna assembly of claim 1 wherein the center axis of the resonant cavity extends orthogonally between a first surface of the metal frame and an opposite second surface of the metal frame.

4. The antenna assembly of claim 1 wherein the resonant cavity forms an oblong aperture in a surface of the metal frame.

5. The antenna assembly of claim 1 wherein the resonant cavity has an interior surface, and the antenna assembly further comprises:

a non-gaseous dielectric material within the resonant cavity, the non-gaseous dielectric material maintaining separation among the metal plate, the metal feed line, and the interior surface of the resonant cavity.

6. The antenna assembly of claim 1 further comprising:

a radio frequency signal source electrically connected to the metal feed line, the metal feed line being positioned to capacitively drive the resonant cavity.

7. The antenna assembly of claim 1 further comprising:

a radio frequency signal source electrically connected to the metal feed line, the metal feed line being positioned to capacitively drive the metal plate to capacitively drive the resonant cavity.

8. The antenna assembly of claim 1 further comprising:

a radio frequency signal source electrically connected to the metal feed line, the metal feed line being positioned to capacitively drive the resonant cavity predominantly in a first frequency band and to capacitively drive the metal plate to capacitively drive the resonant cavity predominantly in a second frequency band.

9. The antenna assembly of claim 8 wherein the width and a center frequency of the first frequency band are dependent upon the size of the resonant cavity.

10. The antenna assembly of claim 8 wherein the width and a center frequency of the second frequency band are dependent upon the size of the metal plate and the depth the metal plate is positioned within the resonant cavity from an exterior surface of the metal frame.

11. The antenna assembly of claim 8 wherein the ranges of the first frequency band and the second frequency band are dependent upon impedance matching contributions of a geometry of the at least a portion of the metal feed line within the resonant cavity and the position of the metal feed line along the center axis.

12. A computing device comprising:

a metal frame forming an exterior surface of the computing device and including an array of resonant cavities, each resonant cavity having a center axis and defining a volume within the metal frame, each volume containing:

a corresponding metal plate positioned within the volume on the center axis of the resonant cavity, and a corresponding metal feed line positioned to capacitively drive the corresponding metal plate and the resonant cavity, at least a portion of the corresponding metal feed line being positioned within the volume on the center axis of the resonant cavity.

13. The computing device of claim 12 wherein each resonant cavity forms an oblong aperture in a surface of the metal frame.

14. The computing device of claim 12 wherein each resonant cavity has an interior surface, and the computing device further comprises:

a non-gaseous dielectric material within each resonant cavity, the non-gaseous dielectric material maintaining separation among the corresponding metal plate, the corresponding metal feed line, and the interior surface of the resonant cavity.

15. The computing device of claim 12 further comprising:

a radio frequency signal source electrically connectable to the corresponding metal feed line of each resonant cavity, the corresponding metal feed line being positioned to capacitively drive the resonant cavity predominantly in a first frequency band and to capacitively drive the corresponding metal plate to capacitively drive the resonant cavity predominantly in a second frequency band.

16. The computing device of claim 15 wherein the width and a center frequency of the first frequency band are dependent upon the size of the resonant cavity.

17. The computing device of claim 15 wherein the width and a center frequency of the second frequency band are dependent upon the size of the metal plate and the depth the metal plate is positioned within the resonant cavity from an exterior surface of the metal frame.

18. The computing device of claim 15 wherein the ranges of the first frequency band and the second frequency band are dependent upon impedance matching contributions of a geometry of the at least a portion of the metal feed line within the resonant cavity and the position of the metal feed line along the center axis.

19. A method of selectively driving antenna assemblies of a computing device, each antenna assembly including a metal frame including a resonant cavity having a center axis and defining a volume within the metal frame, a metal plate positioned within the volume on the center axis of the resonant cavity, and a metal feed line, the method comprising:

selectively setting a radio frequency signal source electrically connected to at least one of the metal feed lines to provide a radio frequency signal having one of a first frequency and a second frequency;

capacitively driving at least one of the metal plates by the at least one of the metal feed lines at the first frequency, the at least one of the metal plates resonating to capacitively drive at least one of the resonant cavities to resonate predominantly in a first frequency band; and capacitively driving the at least one of the resonant cavities by the at least one of the metal feed lines at the second frequency to resonate predominantly in a second frequency band.

20. The method of claim 19 wherein the capacitively driving operations comprises:

scanning the radio frequency signal across the metal feed lines of the antenna assemblies.

* * * * *